US007343896B2

(12) United States Patent
Grant et al.

(10) Patent No.: US 7,343,896 B2
(45) Date of Patent: Mar. 18, 2008

(54) CARBURETOR VALVE CONTROL LINKAGE

(76) Inventors: Barry S. Grant, Route 1, Box 1900, Dahlonega, GA (US) 30533; Scott B. Alm, 422 Gold Crest Dr., Dahlonega, GA (US) 30533

( * ) Notice: Subject to any disclaimer, the term of this patent is extended or adjusted under 35 U.S.C. 154(b) by 0 days.

(21) Appl. No.: 11/397,793

(22) Filed: Apr. 4, 2006

(65) Prior Publication Data

US 2006/0244158 A1 Nov. 2, 2006

Related U.S. Application Data

(60) Provisional application No. 60/667,961, filed on Apr. 4, 2005.

(51) Int. Cl.
*F02M 1/02* (2006.01)
*F02M 1/10* (2006.01)
*F02M 11/02* (2006.01)

(52) U.S. Cl. ..... 123/336; 123/400; 261/39.3; 261/41.3

(58) Field of Classification Search ..... 123/336, 123/337, 367, 400; 261/41.3, 41.4, 41.5, 261/39.2, 39.3, 39.4, 39.6
See application file for complete search history.

(56) References Cited

U.S. PATENT DOCUMENTS

| | | | | |
|---|---|---|---|---|
| 3,741,178 | A * | 6/1973 | Cedar | 123/336 |
| 4,730,181 | A * | 3/1988 | Perkins | 340/467 |
| 5,809,972 | A * | 9/1998 | Grant | 123/478 |
| 5,915,355 | A * | 6/1999 | Andreasson | 123/336 |
| 6,575,875 | B2 * | 6/2003 | Holmes | 477/121 |
| 6,698,397 | B2 * | 3/2004 | Cook | 123/399 |
| 6,769,396 | B2 * | 8/2004 | Geyer et al. | 123/336 |
| 7,017,552 | B2 * | 3/2006 | Gerhardy | 123/400 |

* cited by examiner

*Primary Examiner*—Willis R. Wolfe
*Assistant Examiner*—Johnny H. Hoang
(74) *Attorney, Agent, or Firm*—Thomas, Kayden, Horstemeyer & Risley, LLP

(57) ABSTRACT

A carburetor for a high performance vehicle includes an actuator lever mounted to a first valve linkage for rotating a first pair of carburetor butterfly valves and a crank mounted to a second valve linkage for rotating a second pair of carburetor butterfly valves, a cam mounted on the actuator lever for engaging and moving said crank and rotating said second pair of valves in response to the movement of the actuator lever, and a quick disconnect coupling between said actuator lever and said cam such that the cam is removable from said actuator lever and can be replaced by another cam.

13 Claims, 5 Drawing Sheets

CARBURETOR VALVE CONTROL LINKAGE

CROSS-REFERENCE TO RELATED APPLICATION

This application claims priority to now abandoned U.S. provisional application entitled, "Carburetor Valve Control Linkage," having Ser. No. 60/667,961, filed Apr. 4, 2005, which is entirely incorporated herein by reference.

FIELD OF THE INVENTION

This invention concerns carburetors for engines of high performance vehicles, such as race cars that perform on oval tracks. More particularly, this invention concerns a four barrel carburetor with a progressive linkage for controlling the movement of the secondary butterfly valves.

BACKGROUND OF THE INVENTION

Some high performance engines that are used in race cars have so much power that there is a likelihood of the wheels of the car spinning against the pavement during acceleration. When the wheels of a vehicle spin, the lost traction between the wheels and the road results in lost acceleration performance of the vehicle.

In order to avoid the spinning of the wheels during acceleration of a racing vehicle the manufacturers of carburetors have developed progressive butterfly valve linkages that begin opening the primary butterfly valves before the secondary butterfly valves are opened. When the primary butterflies have been opened to a predetermined degree, more movement of the linkage continues the opening of the primary butterflies and begins to open of the secondary butterfly valves. With this progressive linkage arrangement, the application of too much power immediately upon the start of throttle treadle travel can be avoided, and the driver can continue to depress the accelerator to progressively open the secondary butterflies.

It is desirable to be able to change the performance of the progressive linkage of the carburetor so as to enable the driver to have longer performance of the engine with only the primary butterflies open, and then later open the secondaries. For example, on a slicker track, the driver is likely to want to continue with the progressive opening of only the primary butterflies to allow the vehicle to accelerate more slowly without loss of traction, and then open the secondary butterflies after a desirable speed has been reached. Conversely, if the race track conditions are such that the driver is not concerned with loss of traction during the early performance of the engine, it would be desirable to modify the progressive linkage so that the secondary butterflies of the carburetor would open earlier during the progressive opening of the primary butterflies.

In the past, there have been two primary methods that allowed for the modification of the timing between the primary butterfly valves and the activation of the secondary butterfly valves of a carburetor. One method required the mechanic to loosen the screws that connect the parts of the linkage together, remove the part and then substitute a new part of a different shape in the linkage. This is somewhat cumbersome and tedious for the mechanic, and there is a hazard that the screws that connect the parts together may be dropped and lost in the engine of the vehicle, and replacement screws must be used.

The second method consisted of a link and pin system. To change the secondary timing, a cotter pine (or like retention device) needed to be removed and the link changed and installed in a different location, and the cotter pine reinstalled. Again, this is somewhat cumbersome and tedious to the mechanic, and there is the hazard that the link or pin can be dropped or lost.

Accordingly, it would be desirable to provide a carburetor with a progressive linkage that can be quickly changed so as to modify the degree of opening of the primary butterfly valves prior to the initiation of the opening of the secondary butterfly valves in order to enhance the performance of the vehicle on various track surfaces.

SUMMARY OF THE INVENTION

Briefly described, the present invention concerns an improved carburetor of a high performance vehicle having a quick change progressive linkage that controls the progressive opening of the butterfly valves of the base plate. The linkage enables the mechanic to expediently and accurately replace the cam installed in the progressive linkage with another cam that might be more desirable for the track conditions where the vehicle is to perform.

The base plate of a carburetor that includes four openings that align with the four Venturi openings of the carburetor housing includes a primary throttle shaft that controls the primary butterfly valves in two of the openings and a secondary throttle shaft that controls the secondary butterfly valves in the other two openings. The primary and secondary throttle shafts extend parallel to each other and out of one side of the base plate. An actuator lever is fixedly connected to the protruding end of the primary throttle shaft, and the rotation of the actuator lever results in direct rotation of the primary butterfly valves in two of the openings of the base plate.

A cam is mounted to the actuator lever so that when the actuator lever rotates to progressively open the primary butterflies, the cam eventually engages and rotates a cam follower on the secondary throttle shaft, thereby rotating the secondary butterflies.

The cam of a preferred embodiment comprises a closed track cam that is releasably mounted to the actuator lever, and a cam follower is connected to the secondary throttle shaft and follows the tracks of the closed track cam. The closed track cam has a first track that is shaped so as to not move the cam follower of the secondary throttle shaft during the early portion of the rotation of the actuator lever and a second track that is shaped so as to apply a turning force to the cam follower that results in turning the secondary cam shaft and opening the secondary butterflies.

A quick disconnect coupling is formed between the actuator lever and the closed track cam. A slotted mounting shoe is affixed to the actuator lever and the cam includes a mounting tongue that fits into the slot of the slotted mounting shoe. When the slot and the tongue are aligned, they each include aligned lock pin openings, and a lock pin is inserted through the aligned openings, thereby rigidly mounting the closed track cam to the actuator lever.

When the closed track cam is to be replaced, the lock pin is withdrawn from the aligned openings of the quick disconnect coupling, whereupon the closed track cam is freely removed from the mounting tongue. A replacement cam with its mounting tongue identical to the shape of the mounting tongue of the previous cam is placed in the mounting slot of the actuator lever, and the lock pin is reinserted in the aligned openings.

With this arrangement, the mechanic can easily reach the lock pin of the carburetor assembly, withdraw it and thereby disconnecting the closed surface cam from the actuator lever, slide the cam track out over the cam follower of the secondary throttle shaft, and then in reverse order, mount the replacement closed track cam on the actuator lever. This can be performed with little likelihood of hazardous contact with the hot surfaces of the engine and its components, little hazard of losing parts in the engine compartment, and with the assurance of being able to make an accurate and expedient replacement of the closed track cam.

BRIEF DESCRIPTION OF THE DRAWINGS

FIG. 3 is a perspective view of the actuator lever, showing the bottom surface of the base plate and showing the closed track cam released from the actuator lever, and the locking pin withdrawn from the cam and lever.

DETAILED DESCRIPTION

Figure 1:
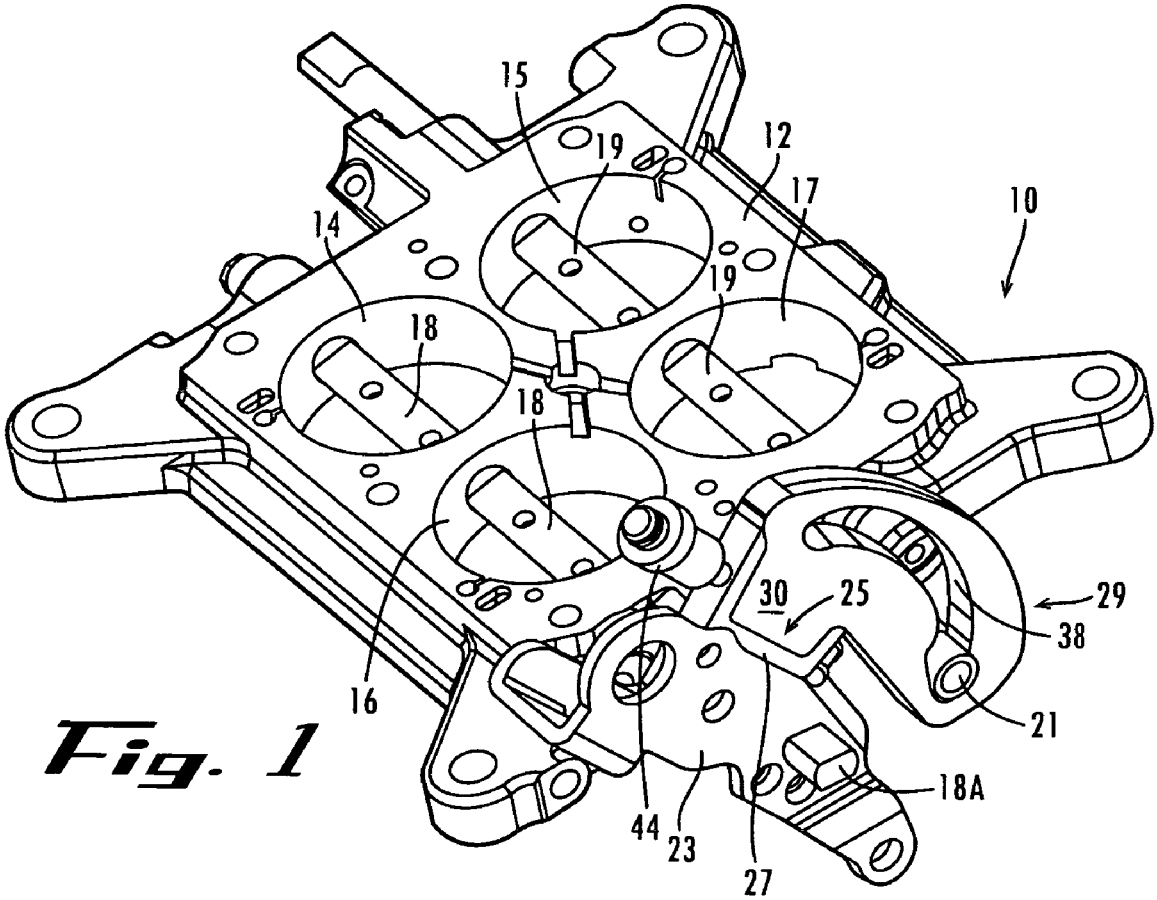
FIG. 1 is a perspective view of the base plate of a four valve carburetor, showing a closed track cam mounted to the actuator lever.
Figure 2:
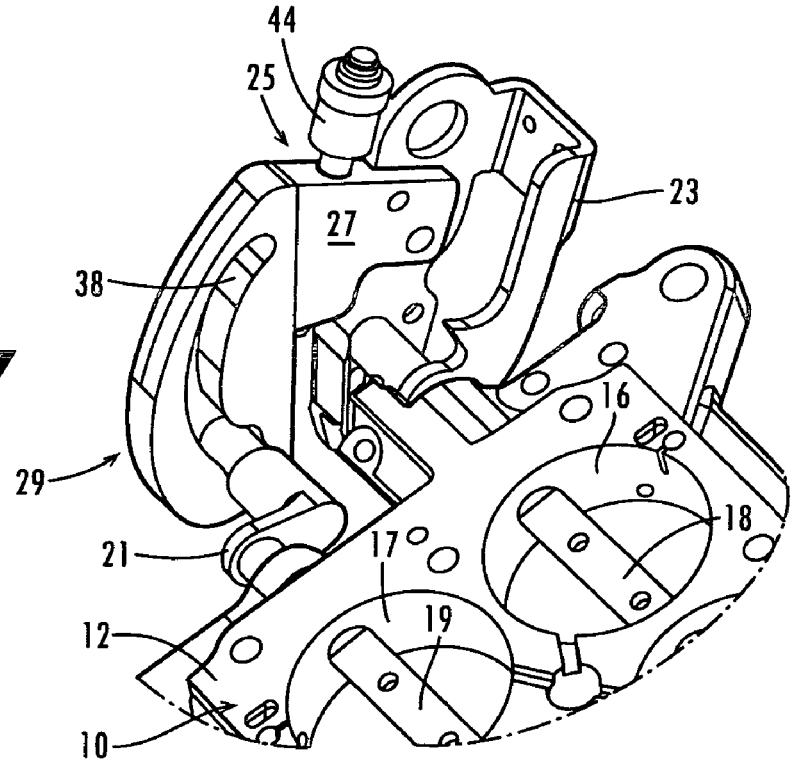
FIG. 2 is a more detailed perspective illustration of the other side of the closed track cam as mounted to the actuator lever.

Referring now in more detail to the drawings, in which like numerals indicate like parts throughout the several views, FIG. 1 illustrates a base plate of a carburetor for mounting the carburetor body on the upper surface 12 of the base plate. The base plate defines four openings 14-17 that register with the Venturi openings (not shown) of the carburetor body. Primary throttle shaft 18 extends through openings 14 and 16 and secondary throttle shaft 19 extends through openings 15 and 17. The distal ends of the throttle shafts 18 and 19 extend beyond the side of the base plate. As shown in FIG. 2, the distal end of secondary throttle shaft 19 is formed with a crank linkage 21.

Actuator lever 23 is mounted to the flattened end portion 18A of the primary throttle shaft 18 so that when the actuator lever 23 is rotated about the primary crank linkage, it rotates the crank linkage. Butterfly valves (not shown) are mounted to the flats of the primary throttle shaft 18 within the openings 14 and 16 so that the rotation of the primary throttle shaft results in the tilting of the butterfly valves and therefore forms a passage through which the fuel and air can move from the carburetor Venturi openings downwardly into the runners of the engine.

Figure 5:
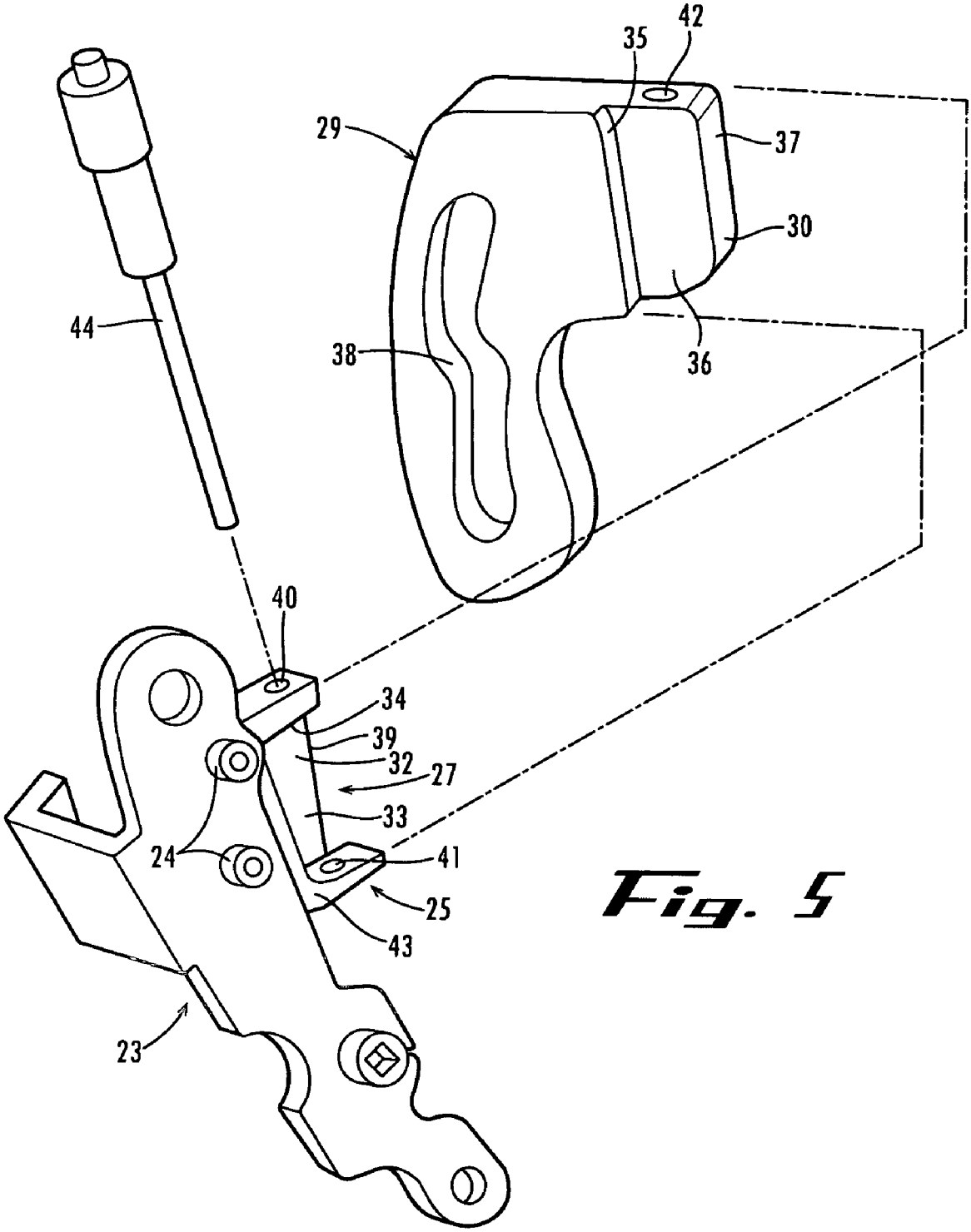
FIG. 5 is a perspective, expanded illustration of the actuator lever and the closed track cam, with the cam turned to reveal the inside of its mounting tongue.

A quick disconnect coupling 25 is rigidly mounted to the upper portion of actuator lever 23 by screws or other conventional connectors 24 (FIG. 5). The quick disconnect coupling includes a mounting shoe 27 and a closed track cam 29 that includes a mounting tongue 30 that fits the mounting shoe 27. The mounting shoe 27, being rigidly attached to the actuator lever 23, includes a recess 32 with a flat side wall 33 and a U-shaped perimeter 34. The mounting tongue 30 of the closed track cam 29 is formed with a complementary shape so as to snuggly fit in the U-shaped perimeter 34 of the mounting shoe 27, with its flat surface 36 in abutment with the flat side wall 33 of the mounting shoe, with its U-shaped perimeter 37 engaging the U-shaped perimeter 34 of the mounting shoe 27, and the ledge 35 engaging the edge 39 of the mounting shoe.

As shown in FIG. 5. the mounting shoe 27 defines upper and lower lock pin openings 40 and 41 through the perimeter wall 43 and the mounting tongue 30 of closed track cam 29 includes a lock pin opening 42. The openings 40-42 become aligned with one another when the closed track cam 29 is mounted to the actuator lever 23 by the insertion of the mounting tongue 30 into the mounting shoe 27. When the lock pin openings are aligned, a lock pin 44 is asserted through the aligned openings, thereby locking the closed track cam 29 to the actuator lever 23. Likewise, the closed track cam 29 can be quickly removed from the actuator lever 23 by withdrawing the lock pin 44 from the aligned openings of the mounting tongue of the closed track cam and the mounting shoe 27.

When the closed track cam 29 is mounted to the mounting shoe by the quick disconnect coupling 25, the crank linkage 21 of the secondary throttle shaft 19 is moved telescopically into the confines of the closed track cam 29. Thus, when the closed track cam is rotated, the closed track 38 tends to move the crank linkage 21, thereby rotating the secondary throttle shaft 19 and its butterfly valves that are located in the openings 15 and 17 of the base plate 10.

Figure 6:
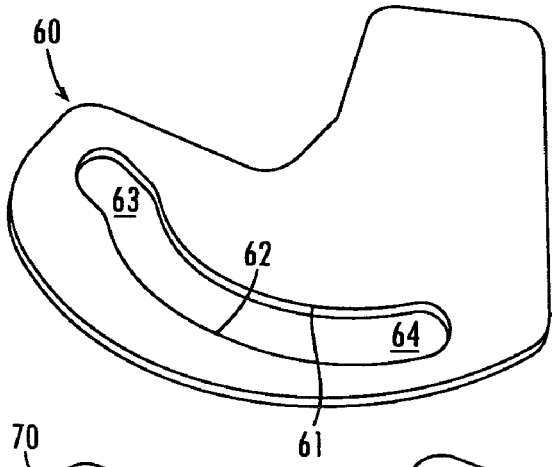
Figure 7:
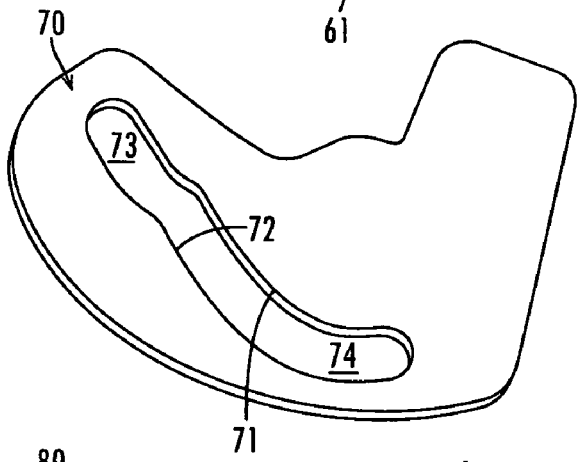

As illustrated in FIGS. 6-9, a plurality of closed track cams are available for mounting to the actuator lever 23 of the carburetor base plate 10. FIG. 6 shows a closed track cam 60 that has opposed cam surfaces 61 and 62 that define a first track 63 and a second track 64. The tracks 63 and 64 are formed on a "one-to-one" relationship with respect to the actuator lever, so that when the actuator lever is rotated, the closed track cam 60 rotates the secondary throttle shaft 19 in unison with the primary throttle shaft 18.

Figure 7:
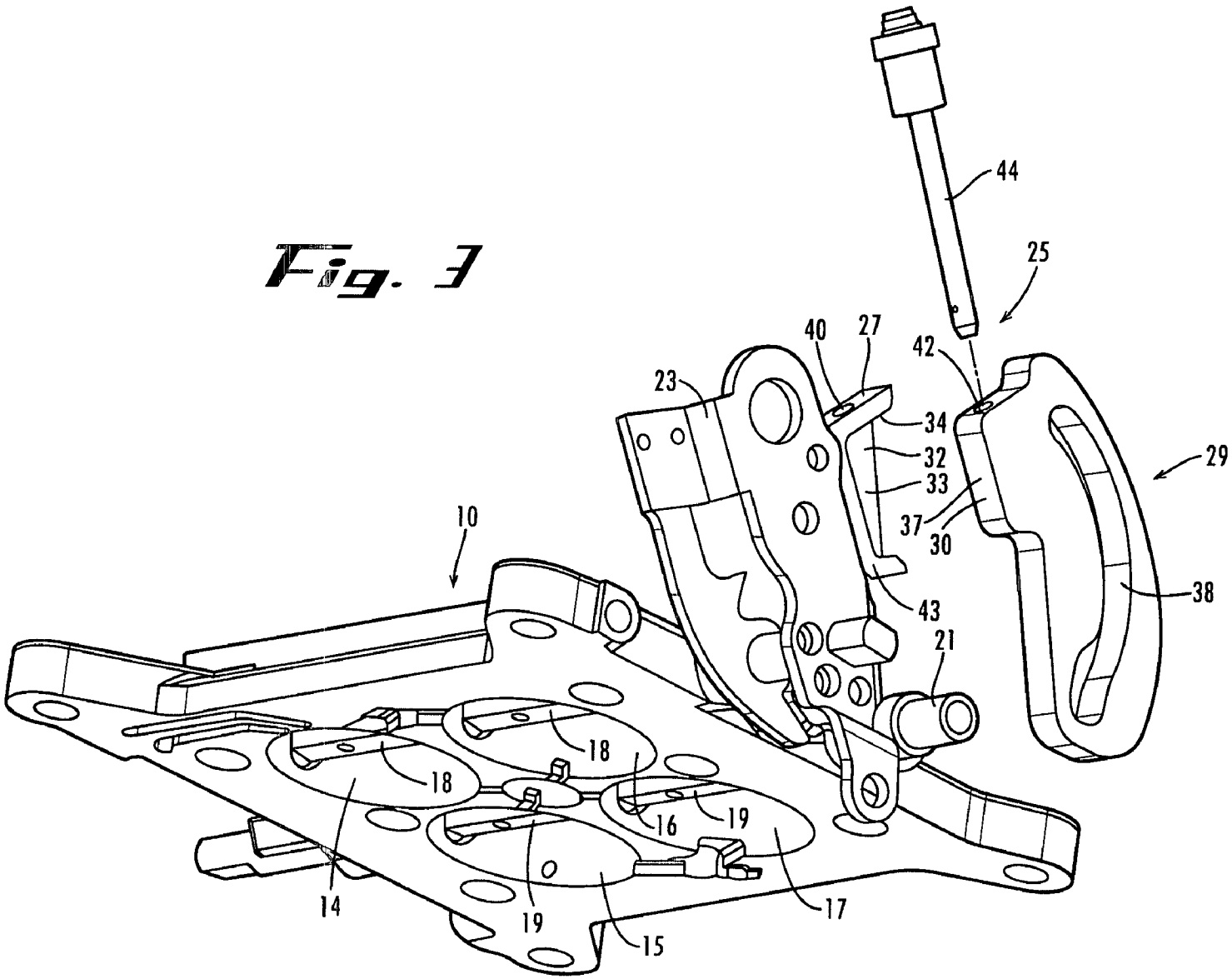
FIGS. 6-9 are illustrations of cams having different shaped closed track cam surfaces for opening the secondary butterflies at different throws of the primary butterflies.
Figure 4:
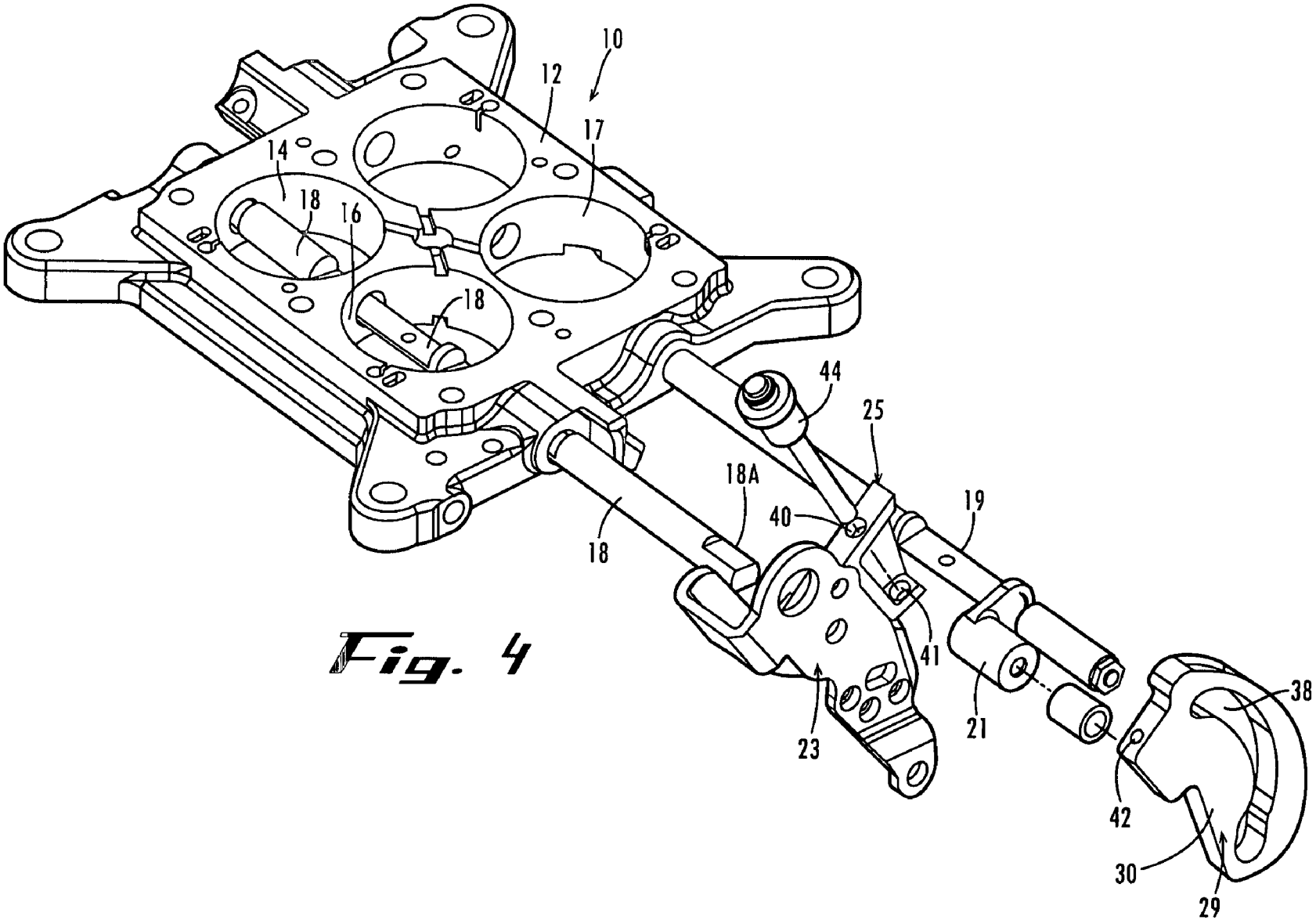
FIG. 4 is another perspective illustration of the base plate, but with the actuator lever and closed track cam expanded laterally from the base plate to reveal the primary throttle shaft and the secondary throttle shaft.

The closed track cam 70 of FIG. 7 shows another closed track having opposed surfaces 71 and 72 defining first track 73 and second track 74 that straddle the crank linkage 21 of the secondary throttle shaft 19. The closed track of cam 70 is a 30° cam in that it permits the primary throttle shaft 18 to be rotated by the movement of the actuator lever 23 for up to 30° while first track 73 passes about crank linkage without imparting motion to the crank linkage before the second track reaches the crank linkage and begins the rotation of the crank linkage 21 of the secondary throttle shaft.

Figure 8:
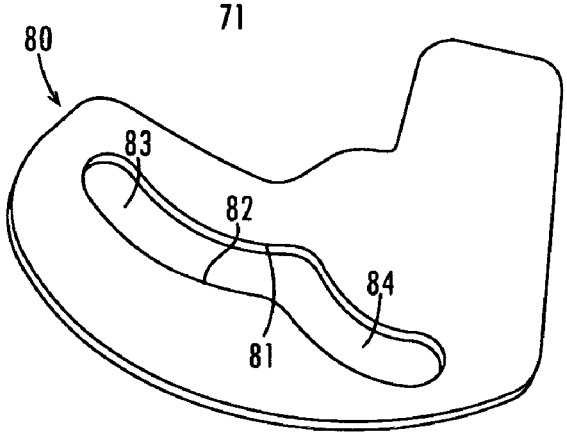

FIG. 8 illustrates a 60° closed track cam 80 having opposed surfaces 81 and 82 and first and second tracks 83 and 84. The track 83 permits 60° rotation of the primary throttle shaft 18 as the first track 83 passes about the crank linkage 21 of the secondary throttle shaft before beginning the rotation of crank linkage 21, so that the primary butterflies of the primary throttle shaft 18 will be two-thirds open before the beginning of the opening of the secondary butterflies of the secondary throttle shaft 19. When the second track 84 reaches the crank linkage it begins the rotation of the secondary throttle shaft.

Figure 9:
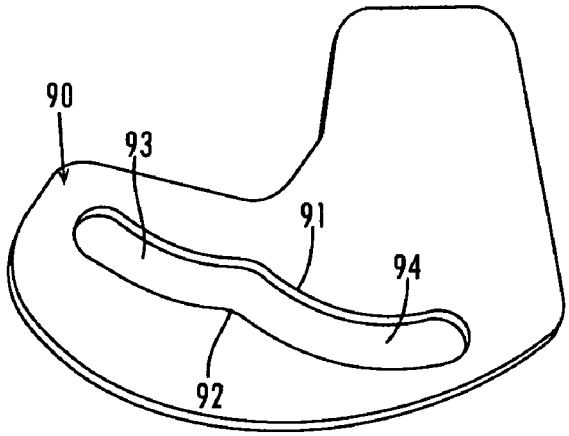

Likewise, FIG. 9 shows a 45° closed track cam 90 having its opposed surfaces 91 and 92 and first and second tracks 93 and 94. The second track begins the rotation of the secondary throttle shaft 19 only after the primary throttle shaft has been rotated 45°.

While FIGS. 6-9 illustrate specific closed track cam surfaces, it should be understood that various other cam track surfaces can be employed, including open track cam track surfaces.

While the specification and drawings disclose preferred embodiments of the invention, it should be understood that variations and modifications thereof may be made without departing from the concept and spirit of the invention as disclosed by the following claims.

The invention claimed is:

1. A carburetor for a high performance vehicle, said carburetor including a base plate, first and second valve openings in said base plate for aligning with Venturi openings of a carburetor housing, a first valve positioned in said first valve opening and a second valve positioned in said second valve opening, a first valve linkage operatively connected to said first valve and a second valve linkage operatively connected to said second valve, an actuator lever mounted to said first valve linkage for rotating said first valve linkage and said first valve, a crank mounted to said second valve linkage for rotating said second valve linkage and said second valve, a cam mounted to said actuator lever for engaging and moving said crank and rotating said second valve linkage and said second valve in response to the movement of the actuator lever, and a quick disconnect coupling between said actuator lever and said cam such that the cam is removable from said actuator lever and can be replaced by another cam.

2. The carburetor of claim 1, wherein said first valve opening comprises a first pair of valve openings and second valve opening comprises a second pair of valve openings, said first valve comprises a first pair of valves positioned in said first pair of valve openings, and said second valve comprises a second pair of valves positioned in said second pair of valve openings, said first valve linkage operatively connected to said first pair of valves and said second valve linkage operatively connected to said second pair of valves, such that movement of said actuator lever rotates said first pair of valves and said second pair of valves.

3. The carburetor of claim 1, wherein said quick disconnect coupling comprises:

a lock pin that locks said tongue and said mounting shoe together.

4. The carburetor of claim 1, wherein said quick disconnect coupling comprises:

said actuator lever includes a mounting shoe defining a recess, said cam includes a tongue that mates with said recess of said mounting shoe, a lock pin that extends through said mounting shoe and said tongue and locks said tongue and said mounting shoe together.

5. A carburetor for a high performance vehicle, said carburetor including a first valve linkage for operative connection to a first pair of valves and a second valve linkage for operative connection to a second pair of valves, an actuator lever mounted to said first valve linkage for rotating said first valve linkage and said first pair of valves, a crank mounted to said second valve linkage for rotating said second valve linkage and said second pair of valves, a cam mounted to said actuator lever for engaging and moving said crank and rotating said second valve linkage and said second pair of valves in response to the movement of the actuator lever, and a quick disconnect coupling between said actuator lever and said cam such that the cam is removable from said actuator lever and can be replaced by another cam.

6. The carburetor of claim 5, wherein said quick disconnect includes overlapping parts and a connector for holding the overlapping parts together.

7. The carburetor of claim 5, wherein said quick disconnect includes a shoe including a sidewall, a perimeter extending laterally from said sidewall and defining recess with said sided wall, a tongue sized and shaped to register with said recess, and a lock element engagable with said shoe and said tongue for locking said tongue to said shoe.

8. The carburetor of claim 7, wherein said lock element comprises a lock pin sized and shaped to be insertable through said perimeter and said tongue.

9. A carburetor for a high performance vehicle, said carburetor including an actuator lever for rotating a first pair of carburetor valves in a base plate of a carburetor housing, a crank for rotating a second pair of carburetor valves in the base plate of the carburetor housing, a plurality of cams for mounting to said actuator lever for engaging and moving said crank and rotating said second pair of valves in response to the movement of the actuator lever, each of said cams having closed cam tracks, with the closed cam track of each cam being of different configuration than the closed cam tracks of the other cams to actuate the second pair of carburetor valves at different degrees of movement of the actuator lever, and a quick disconnect coupling between said actuator lever and said cam such that the cams are removable from said actuator lever and can be replaced by another cam.

10. The carburetor of claim 9, wherein said quick disconnect includes overlapping parts and a connector for holding the overlapping parts together.

11. The carburetor of claim 9, wherein said quick disconnect includes a shoe including a sidewall, a perimeter extending laterally from said sidewall and defining recess with said sided wall, a tongue sized and shaped to register with said recess, and a lock element engagable with said shoe and said tongue for locking said tongue to said shoe.

12. The carburetor of claim 9, wherein said lock element comprises a lock pin sized and shaped to be insertable through said perimeter and said tongue.

13. A carburetor for a high performance vehicle including:

an actuator lever mounted to a first valve linkage for rotating a first pair of carburetor butterfly valves, a crank mounted to a second valve linkage for rotating a second pair of carburetor butterfly valves, a plurality of cams for interchangeably mounting on the actuator lever for engaging and moving said crank and rotating said second pair of valves in response to the movement of the actuator lever, said plurality of cams comprising cams having different shaped cam tracks for rotating the second pair of carburetor butterfly valves at different degrees of rotation of the actuator lever, and a quick disconnect coupling between said actuator lever and said cam such that the cam is removable from said actuator lever and can be replaced by another cam.

* * * * *